US010267043B2

(12) United States Patent
Conner

(10) Patent No.: US 10,267,043 B2
(45) Date of Patent: Apr. 23, 2019

(54) ENHANCED GUTTER HANGER

(71) Applicant: Darren Dean Conner, St. John, IN (US)

(72) Inventor: Darren Dean Conner, St. John, IN (US)

( * ) Notice: Subject to any disclaimer, the term of this patent is extended or adjusted under 35 U.S.C. 154(b) by 0 days.

(21) Appl. No.: 15/624,502

(22) Filed: Jun. 15, 2017

(65) Prior Publication Data

US 2018/0038111 A1 Feb. 8, 2018

Related U.S. Application Data

(60) Provisional application No. 62/350,480, filed on Jun. 15, 2016.

(51) Int. Cl.

| | |
|---|---|
| ***E04D 13/072*** | (2006.01) |
| ***E04D 13/068*** | (2006.01) |
| ***E04D 13/064*** | (2006.01) |
| ***E04D 13/00*** | (2006.01) |

(52) U.S. Cl.
CPC ..... *E04D 13/0725* (2013.01)

(58) Field of Classification Search
CPC . E04D 13/0725; E04D 13/076; E04D 13/064; E04D 13/0685
USPC ..... 248/48.1, 48.2, 231.91, 248, 903; 52/12, 52/18
See application file for complete search history.

(56) References Cited

U.S. PATENT DOCUMENTS

| | | | | |
|---|---|---|---|---|
| 3,295,803 | A | 1/1967 | Blayden | |
| 3,752,428 | A | 8/1973 | Trostle et al. | |
| 4,294,422 | A | 10/1981 | Odekirk | |
| 4,776,544 | A | 10/1988 | Williams | |
| 5,004,191 | A | 4/1991 | Corry | |
| 5,271,192 | A | 12/1993 | Nothum et al. | |
| 5,388,377 | A | 2/1995 | Faulkner | |
| 5,845,435 | A | 12/1998 | Knudson | |
| 5,862,631 | A | 1/1999 | Attaway et al. | |
| 6,209,826 | B1 | 4/2001 | Pratt, Jr. | |
| 6,254,039 | B1 | 7/2001 | Zimmerman | |
| 6,453,622 | B1 | 9/2002 | Walters | |
| 6,543,729 | B1 | 4/2003 | Ylonen | |
| 6,631,587 | B2 | 10/2003 | Lynch | |
| 6,658,796 | B1 | 12/2003 | Higgins | |
| 6,726,155 | B1 * | 4/2004 | Zimmerman | E04D 13/0725 248/48.1 |
| 6,993,870 | B2 | 2/2006 | McDonald et al. | |
| 7,117,643 | B2 | 10/2006 | Brown | |
| 7,494,095 | B2 | 2/2009 | Walker et al. | |
| 7,523,894 | B1 | 4/2009 | Eddy | |

(Continued)

*Primary Examiner* — Tan Le
(74) *Attorney, Agent, or Firm* — Wood, Phillips, Katz, Clark & Mortimer

(57) ABSTRACT

A gutter hanger for hanging a rain gutter on the fascia board of a structure or building. The gutter hanger includes an elongated horizontal top member connected to a downwardly extending back member. A bore for a fascia screw extends from a bump in the inner surface of the back member the outer or back surface of the back member or leg. The bump includes a bearing surface generally perpendicular to the axis of the bore. The gutter hanger also includes an upwardly extending protrusion to engage the lip of the gutter. The top member also includes a threaded bore hole to accept a screw, so that the top member may be attached to the top front of the gutter with a threaded fastener.

8 Claims, 2 Drawing Sheets

(56) References Cited

U.S. PATENT DOCUMENTS

| | | | | |
|---|---|---|---|---|
| 7,730,672 | B2 | 6/2010 | Knudson et al. | |
| 7,861,980 | B1 | 1/2011 | Verbrugge et al. | |
| 8,117,785 | B2 * | 2/2012 | Teichner | E04D 13/076 248/48.1 |
| 8,225,556 | B2 | 7/2012 | Brown | |
| 8,347,557 | B2 | 1/2013 | Minor et al. | |
| 9,624,673 | B2 * | 4/2017 | Conner | E04D 13/0725 |
| 2004/0000098 | A1 | 1/2004 | Knudson | |
| 2004/0211124 | A1 | 10/2004 | Hardin | |
| 2005/0082436 | A1 | 4/2005 | Snell | |
| 2005/0172565 | A1 | 8/2005 | Riley et al. | |
| 2006/0272223 | A1 * | 12/2006 | McDonald | E04D 13/0481 52/12 |
| 2008/0217496 | A1 * | 9/2008 | Wooten | A47B 96/061 248/248 |
| 2010/0251626 | A1 | 10/2010 | Roque Alonso | |
| 2014/0196400 | A1 | 7/2014 | Bell | |
| 2018/0038111 | A1 * | 2/2018 | Conner | E04D 13/0725 |

* cited by examiner

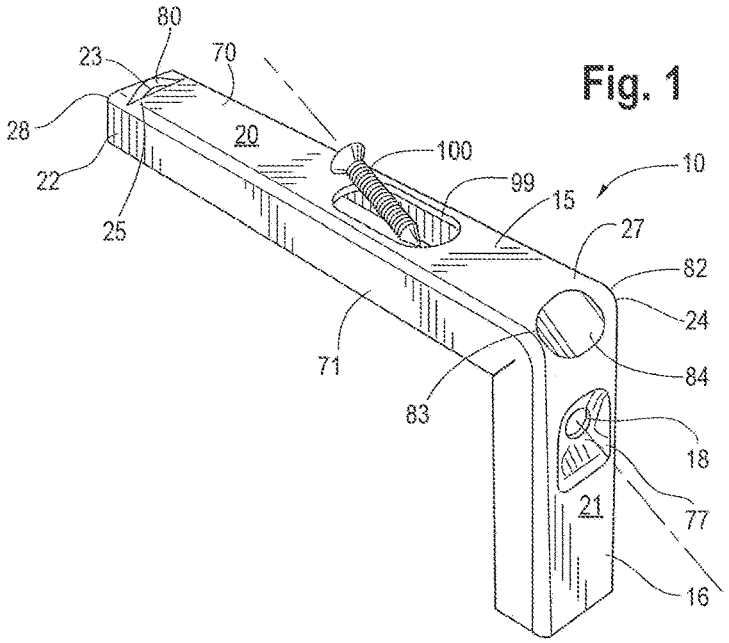
Fig. 1
Fig. 2
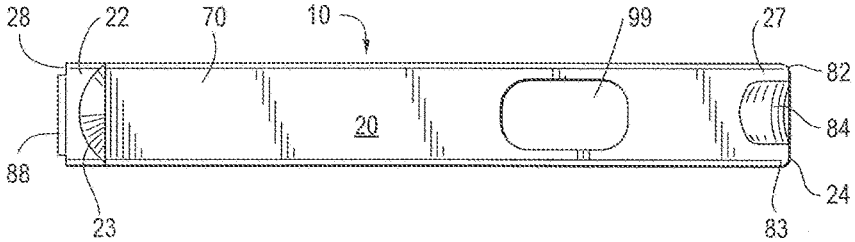
Fig. 3
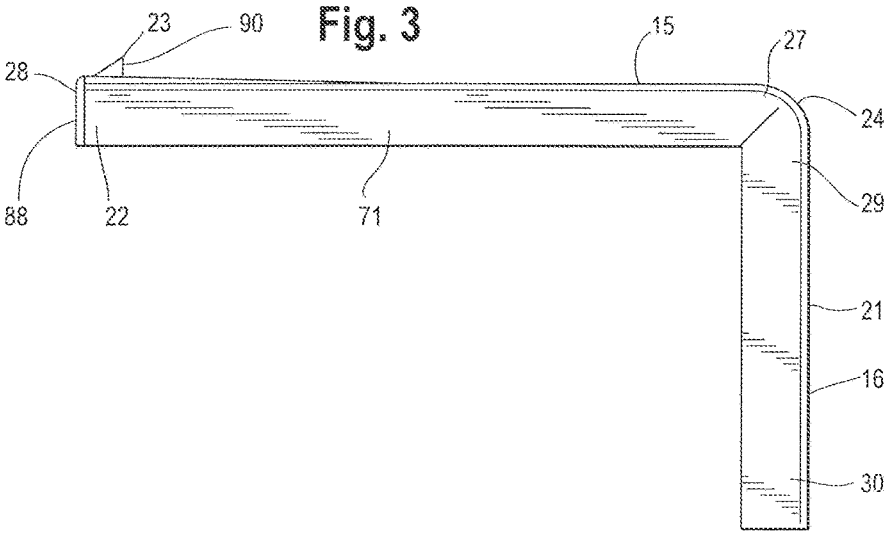

ENHANCED GUTTER HANGER

FIELD OF THE INVENTION

The invention is in the field of hangers for securing rain gutters to structures and buildings.

BACKGROUND OF THE INVENTION

The invention relates to gutters that are typically found on the sides of structures to catch and channel away rainwater that flows off of the structure's roof. The gutters generally have a front side, bottom, and back side. The gutters are generally mounted onto the side of the structure using a plurality of gutter hangers spaced apart from each other along the length of the gutter. The gutter hangers are typically attached to the structure and the gutter with building fasteners, such as screws, nails, and rivets.

Gutter hangers of the prior art are numerous. Some support the gutter from the outside, such as U.S. Pat. No. 4,776,544 to Williams. Others support the gutter internally from the top of the gutter such as U.S. patent application Ser. No. 13/739,745 to Bell. Some gutter hangers of the prior art require the installer to lift the shingles near the fascia board to install the gutter hanger over the back edge of the gutter. This common practice can break the seal at the bottom of the roofing shingles, allowing wind and water to get under the shingles or even tear the shingles, causing damage to the roof and structure. The gutter hanger of the present invention installs in the interior of the gutter, and does not require the installer to lift or otherwise disturb the shingles on the roof of the structure.

SUMMARY OF THE INVENTION

The gutter hanger of the present invention is a significant improvement over the gutter hangers of the prior art. The gutter hanger is generally an L shaped bracket that includes a top portion or leg that interiorly spans the top of the gutter, and a downward extending leg that extends down the back interior side of the gutter. The downward extending leg or support holds the back of the gutter against the fascia board for substantially the entire depth of the gutter, reducing the opportunity for wind to get between the rear of the gutter and the fascia board. This reduces gutter movement from the wind and can increase the life expectancy of the gutter. The downward extending leg is sized so as to act as a gauge during installation of the gutter, the bottom or distal end of the downward extending member being placed at the bottom of the interior of the gutter.

The gutter hanger of the present invention also includes an angled predrilled hole in the downward extending member. The hole accepts a screw for attaching the gutter hanger and gutter to the fascia board of the structure. Because the gutter hanger has a downward extending leg or support that may be as a gauge or guide to fix the distance from the bottom of the gutter, the hole for the screw that attaches the gutter to the fascia board is easily set at the same distance from the bottom of the gutter for each gutter hanger used in an installation. Thus the gutter hanger is used as a guide to insure that all of the hangers are installed consistently at the same level within the gutter, resulting in an improved aesthetic, as the gutters can be kept straighter. Setting a uniform distance from the bottom of the gutter also aids in keeping the front of the gutter uniform in appearance.

It is preferred that the gutter hanger fascia screw is set at a low angle to the top member and a high angle to the downwardly extending member so that the hole made in the gutter by the screw is not too near the bottom of the gutter that there is a risk of water leaking through the hole and penetrating the fascia board. Typically, it is preferred that the fascia screw hole be no lower than half the distance from the gutter back top edge to the bottom of the gutter. Further, the angle of the fascia screw hole preferably allows the drill used to fasten the screw to vertically clear the front edge of the gutter during installation of the fascia screw. With these concerns in mind, the fascia screw may be placed at a wide range of angles, ranging from approximately 10 degrees to 45 degrees from horizontal.

The fascia screw hole or bore may also include a surface that is circumfrential and perpendicular to the axis of the fascia screw hole. This surface provides a surface for the head of the fascia screw to bear upon, lessening the chance of overdriving the screw and possibly damaging the gutter hanger as the head of the fascia screw is accidentally driven into the fascia screw hole, creating a wedge force to split the gutter hanger, or shearing off the head of the screw. In the preferred embodiment, the bearing surface is created by indenting the outer side of the downward extending leg, creating a bump or dimple on the interior side.

The generally horizontal top member includes an access hole or bore in its top surface. The access hole allows the user to install screw into the screw hole in the downward extending leg, and drive the screw into the fascia board with a drill or driver.

In the preferred embodiment, the gutter hanger is made of channel stock. The open side of the channel faces the gutter interior when the gutter hanger is mounted in the gutter. The side walls of the channel stock a cut in a v shape notch where the vertex or corner of the gutter hanger is desired. It is preferred that the notch have sides of 45 degrees. The gutter hanger is then bent at that location so that the edges of the v shape meet, thus adding support to the gutter hanger. In other embodiments, the channel stock can simply be bent into shape without notching the side walls. The downward extending back leg of the gutter hanger extending to the bottom of the gutter, as well as the side edges of the notch resting upon each other, provided added support so that the gutter does not droop or otherwise sag when full of ice and snow.

The nose or front of the top member also includes a predrilled hole that may be threaded. To achieve this with channel stock, a portion of the sides of the channel are removed, and the remaining portion bent down to close off the open end of the channel. The portions of the sides that are removed are generally as long as the channel is deep. This allows for the fixed attachment of the front of the gutter to the gutter hanger by means of a threaded fastener such as a screw. This provides a more secure attachment and support for the gutter, as previous designs such as that shown in the Bell application, to positively attach the front of the gutter to the hanger. Instead, the gutter lip or flange rests on the top of the gutter hanger. If the gutter fills with ice and snow, the added weight can cause the lip of the gutter to bend, creating an unattractive non-uniform appearance. Even worse, the gutter lip could bend enough to fail.

The gutter hanger of the present invention allows the front of the gutter to be attached so that the weight of the contents does not bear on the lip of the gutter, but instead bears on the screw or other fastener. The fastener can be removed and reinstalled multiple times, allowing for other things to the attached to the gutter hanger by way of a threaded fastener. For instance, holiday lights or hooks for hanging holiday lights or planters, or brackets for other things used around a home such as security cameras may be reliably attached to the gutter hanger. As the gutter hanger is strong with the additional support provided by the back leg, the design of the present invention.

For added strength, the gutter hanger of the present invention can include a ridge or flange of material around its perimeter to increase the strength of the hanger but reducing material costs and bulk. The gutter hanger may be as thick or thin as the application requires, so long as the nose the web portions allow for sufficient material to allow for the screw bores or holes.

BRIEF DESCRIPTION OF THE DRAWINGS

FIG. 1 is a top perspective view of the gutter hanger.

FIG. 2 is a top elevation view of the gutter hanger.

FIG. 3 is a side elevation view of the gutter hanger.

DETAILED DESCRIPTION OF THE PREFERRED EMBODIMENT

Figure 4:
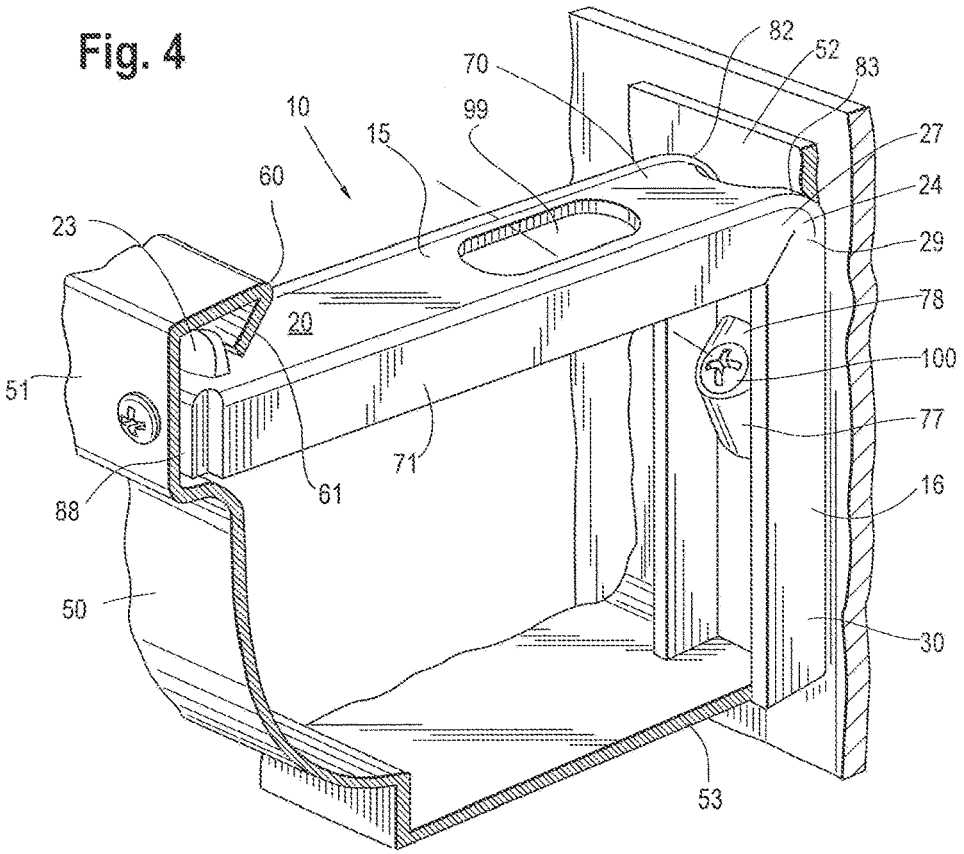
FIG. 4 is a top perspective partial cut away view of the gutter hanger installed in a gutter and attached to a fascia board of a structure.
Figure 5:
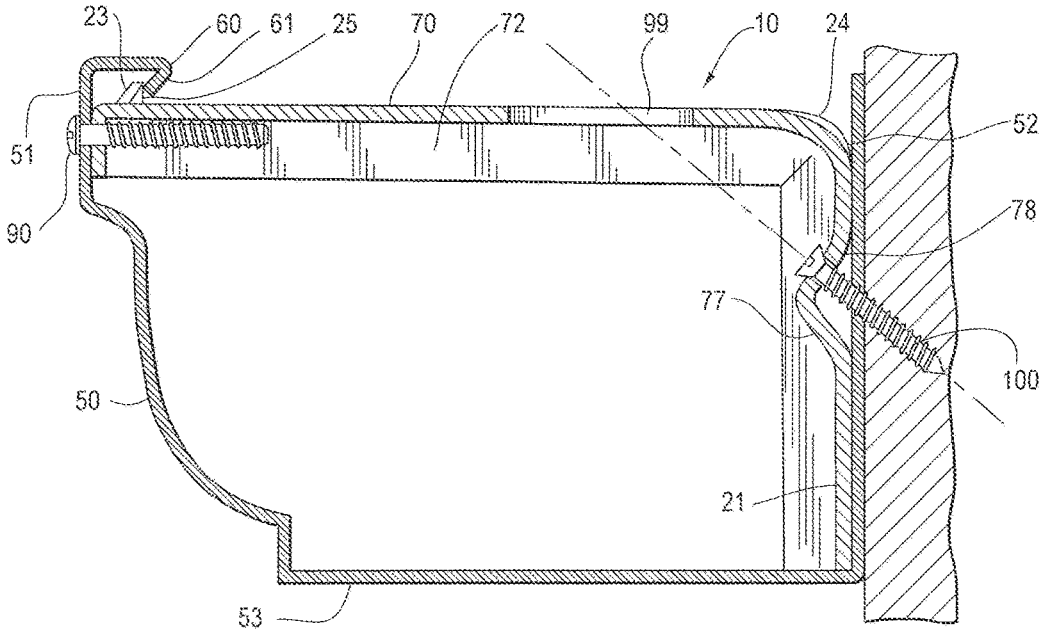
FIG. 5 is a side cross sectional view of the gutter hanger and gutter of FIG. 4.

The foregoing disclosure of specific embodiments is intended to be illustrative of the broad concepts comprehended by the invention. With reference to the figures, the gutter hanger 10 includes an elongated top member or leg 15 and an elongated back member or leg 16. The top member 15 and back member 16 are preferably made of a continuous piece of channel stock having a central wall 70 and two side walls 71 and 72. The channels stock is oriented such that the channel is open to the interior of the gutter when the gutter hanger 10 is placed in the gutter.

The gutter hanger is made by notching the side walls 71 and 72 at the location of the corner or vertex 24. The gutter hanger 10 is then bent to a 90 degree angle. The edges of the notches then meet, allowing the edges of the top member side walls to rest on and receive support from the edges of the back member side walls.

The top leg 15 and back leg 16 are positioned at approximately right angles so that the top leg 15 is horizontally positioned and the back leg 16 is vertically positioned in the gutter 50. The top leg 15 includes a top surface 20 and the back leg 16 includes a back surface 21. The gutter hanger 10 may be constructed of many materials, such as wood, metal, or plastic. It is preferred that the top leg 15 and back leg 16 are integrally formed. In the most preferred embodiment, the gutter hanger 10 is made of aluminum.

The top leg 15 includes a proximal end 27 at the vertex 24 and a distal end 28. The distal end 28 forms the nose 22. The nose 22 includes an upward extending protrusion 23 having a highest point of elevation for engaging the lip 60 of the gutter 50. The back leg 16 includes a proximal end 29 at the vertex 24 and a distal end 30. The top leg 15 is of sufficient length to span from the front 51 of the gutter 50 to the back 52 of the gutter 50. The back leg 16 is of sufficient length to extend down to the bottom 53 of the gutter 50 when the top leg 15 is positioned horizontally in the gutter 50.

The top leg proximal end 27 and the back leg proximal end 29 are joined or merge at a vertex 24. The vertex is created by notching the channel stock sides 71 and 72 at 45 degree angles so that the notch is one of approximately 90 degrees. The vertex 24 may include a recess on the outer surface, creating two ridges 82 and 83 generally parallel to the side walls 71 and 72. The ridges link or connect the proximal ends 27 and 29 of the top member 15 and back member 19.

The back leg or member 16 includes a fascia screw bore or hole 18 for acceptance of a fascia screw 100. The fascia screw bore extends from the inner surface of the back leg 16 to the outer surface 21. The fascia screw bore 18 may be threaded in some embodiments, but it is preferred to not be threaded. The fascia screw bore 18 is preferably arranged at a 45 degree angle from horizontal and exits the back surface 21 of the back leg 16 approximately midway between the vertex 24 and the back leg distal end 30. The fascia screw bore 18 may exit the back surface 21 of the back leg 16 at any point, but it is preferable that the exit be somewhere between the vertex 24 and ⅔ of the distance between the vertex 24 and the back leg distal end 30.

In the most preferred embodiment, the back leg 16 includes a recess or depression or dimple 77 on the outer surface 21. The dimple in the outer surface 21 is also a corresponding bump on the inner surface of the back leg 16. The bump provides a bearing surface 78 located circumferentially about the axis of the fascia screw bore or hole 18, providing a surface of the screw head to bear upon. The bearing surface is preferably generally perpendicular to the fascia screw bore or hole 18.

The nose 22 of the top leg 15 includes protrusion 23 for engaging the lip 60 of the gutter 50. The protrusion 23 extends upwardly from the top surface 20 of the top member or leg 15. The protrusion is generally formed by creating a dimple or recess in the inner surface of the top member 15, causing a protrusion 23 on the outer surface 20 of the channel center wall 70. In the most preferred embodiment, the channel center wall 70 includes a cut 80 to allow a cross section of the center wall 70 to present above the top surface 20. The exposed cross section creates a generally vertical surface 25 to engage the lip 60 of the gutter. The lip 60 generally includes a downwardly extending tab 61 that is flexible, as it has a living hinge connection to flange on the front 51 of the gutter 10. The flexibility allows protrusion 23 to move and snap under the tab 61 upon installation of the gutter hanger 10, with vertical surface 25 of the protrusion 23 engaging the tab 61. The vertical surface 25 faces toward the proximal end 27 of the top member 15.

The protrusion 23 may include ramp 26 extending from the vertical surface 25 to towards proximal end 28 of the top leg 15. The ramp 26 is preferably arcuate in shape from side to side with the highest point being approximately equidistant from each side of the central wall 70. The arcuate shape aids in allowing the gutter hanger 10 to be rotated into position and deflect the lip 61 of the gutter 50 upon installation. The arcuate shape of the ramp 26 also creates an arcuate portion of the perimeter of the vertical surface 25.

The proximal end 28 may terminate in a front tab 88. The front tab 88 is created by bending a portion of the central wall 70 downward until it is generally vertical. In alternate embodiments, one or both of the side walls 71 and 72 could be bent into a similar position.

The front tab 88 of the top leg 15 includes a front screw bore 70. The front screw bore 90 is preferably threaded to accept a front screw 120. However, the front screw bore 90 need not be threaded in all embodiments of the present invention. The front screw bore 90 is generally oriented horizontally.

The top member 15 also includes access hole 99 positioned along the axis of the fascia screw bore or hole 18. The access hole 99 allows for the user to place the screw into the fascia screw bore or hole 18 from above the top member 15, and use a driver or drill to turn the screw into the fascia board, thereby installing the gutter. The access hole 99 may be of any shape, but preferably extends some distance towards the vertex 24 and towards the distal end 28 of the top member 15 from the axis of the fascia screw bore so as to allow for some adjustment of the driver. The access hole is larger than the screw head, and preferably at least twice as large as the fascia screw head.

To install the gutter hanger 10 of the present invention, the gutter hanger is inserted into the well of the gutter 50 at an angle so that the top leg 15 can fit between the back 52 of the gutter and the lip 60 of the gutter. The distal end 30 of the back leg 16 is placed upon the bottom 53 of the gutter 50 and the gutter hanger 10 is rotated so that the back surface 21 contacts the back 52 of the gutter 20, while at the same time the nose 22 of the top leg 15 of the gutter hanger 10 slides under the lip 60 of the gutter 50. The fascia board screw 100 is then screwed into the fascia screw bore 18 and driven through the gutter back 52 and into the fascia board 110, capturing the back 52 of the gutter 50 between the back surface 21 of the gutter hanger and the fascia board 110. Upon installation, the front screw 120 penetrates the front 51 of the gutter 50 opposite the front screw bore 70 and is screwed in, capturing and securing the front 51 of the gutter 50 to the nose 22 of the gutter hanger 10.

The invention claimed is:

1. A gutter hanger, having a top member and a back member, the top member having a top member distal end, a top member proximal end, a top member outer surface, and a top member inner surface, a top member first side wall, a top member second side wall, a top member center wall, the top member first side wall arranged in an opposed relationship to the top member second side wall with the top member center wall positioned therebetween to form a top member channel; the back member having a back member distal end, a back member proximal end, a back member outer surface, and a back member inner surface; a back member first side wall, a back member second side wall, a back member center wall, the back member first side wall arranged in an opposed relationship to the back member second side wall with the back member center wall positioned therebetween to form a back member channel; the back member proximal end and the top member proximal end being joined at a vertex; the back member outer surface including a dimple, the dimple including a bore hole having an axis, the top member including an aperture in the top member center wall communicating between the top member outer surface and the top member inner surface, the bore hole axis being aligned with the aperture.

2. The gutter hanger of claim 1, wherein the top member first side wall and the top member second side wall are cut at a 45 degree angle at the vertex.

3. The gutter hanger of claim 2, wherein the back member first side wall and the back member second side wall are cut at a 45 degree angle at the vertex.

4. The gutter hanger of claim 3 wherein the top member first side wall and the back member first side wall contact each other.

5. The gutter hanger of claim 1 wherein the top member includes a protrusion, the protrusion being a cross section of the center wall.

6. The gutter hanger of claim 1, wherein the dimple forms a protrusion on the back member inner surface, the protrusion including a bearing surface about the bore hole.

7. The gutter hanger of claim 1, wherein the bore hole axis is angled at 45 degrees relative to the back member inner surface.

8. The gutter hanger of claim 1 wherein the bore hole is midway between the vertex and the distal end of the back member.

* * * * *